United States Patent [19]

Tokue et al.

[11] Patent Number: 4,785,582

[45] Date of Patent: Nov. 22, 1988

[54] METHOD AND DEVICE FOR REGULATING VEHICLE DOOR WINDOW

[75] Inventors: Yukiharu Tokue, Yokohama; Sigeru Nakamura, Odawara, both of Japan

[73] Assignees: Nissan Motor Co., Ltd.; OHI Seisakusho Co., Ltd., both of Japan

[21] Appl. No.: 13,250

[22] Filed: Feb. 10, 1987

[30] Foreign Application Priority Data

Feb. 14, 1986 [JP] Japan ..... 61-28915

[51] Int. Cl.[4] ..... E05F 11/52

[52] U.S. Cl. ..... 49/211; 49/227; 49/352; 49/374

[58] Field of Search ..... 49/352, 349, 348, 360, 49/350, 351, 374, 375, 211, 227

[56] References Cited

U.S. PATENT DOCUMENTS

| | | | |
|---|---|---|---|
| 3,219,335 | 11/1965 | Burridge | 49/375 X |
| 3,591,982 | 7/1971 | Nantau | 49/350 X |
| 4,219,968 | 9/1980 | Sakai et al. | 49/374 X |
| 4,241,542 | 12/1980 | Podolan et al. | 49/352 |
| 4,420,906 | 12/1983 | Pickles | 49/349 X |
| 4,575,467 | 3/1986 | Bickerstaff | 49/348 X |

FOREIGN PATENT DOCUMENTS

| | | |
|---|---|---|
| 3243123 | 5/1984 | Fed. Rep. of Germany . |
| 56-81785 | 7/1981 | Japan . |
| 57-33685 | 2/1982 | Japan . |
| 353169 | 7/1931 | United Kingdom . |
| 1305694 | 2/1973 | United Kingdom . |

*Primary Examiner*—Philip C. Kannan

*Attorney, Agent, or Firm*—Leydig, Voit & Mayer

[57] ABSTRACT

A window regulator is disclosed wherein when a window pane is slightly lowered from its full-closed uppermost position, the window pane is shifted toward an inner panel of the door, and when the window pane is moved up to the slight-open position from its full-open lowermost position, the window pane is shifted toward an outer panel of the door, so that a so-called "flush surface arrangement" is achieved in a door window construction.

13 Claims, 6 Drawing Sheets

1
2
3
4
5
6
7
11
13
14
15
16
21
22
24
25
25a
26
29
30
35
37
38
40
44
44a
45
48
52
52a
52b
54
55
55a
57
61
62
62c
63
64

Y'
1
2
3
4
5
6
7
10
11
13
14
15
16
21
22
24
25
25a
26
29
30
35
37
38
40
44
44a
45
48
52
52a
52b
54
55
55a
57
61
62
62c
63
64

Y
1
2
3
4
5
6
7
10
11
13
14
15
16
21
22
24
25
25a
26
29
30
35
37
38
40
44
44a
45
48
53
54
55
55a
57
61
62
62c
63
64

METHOD AND DEVICE FOR REGULATING VEHICLE DOOR WINDOW

BACKGROUND OF THE INVENTION

1. Field of the Invention

The present invention relates in general to a window regulator particularly for motor vehicles, and more specifically to a method and a device for regulating a window pane during its upward and downward movement.

2. Description of the Prior Art

Hitherto, various types of window regulators have been propsed and put into practical use particularly in the field of motor vehicles. Some of them are of a type which comprises guide rails secured to the vehicle door and window pane carriers (or a carrier) slidable along the guide rails for effecting upward and downward movement of the window pane. Japanese Patent First Provisional Publications Nos. 57-33685 and 56-81785 show some of these conventional window regulators.

In the meantime, in order to reduce air resistance of a motor vehicle under cruising and improve the external appearance of the same, it is preferable to employ in the door window construction a so-called "flush surface body arrangement" in which upon full closing of the window, the window pane becomes substantially flush with both the outer panel of the door and the outer panel of the vehicle body.

However, in the conventional window regulators, the above-mentioned flush surface body arrangement has been made without satisfaction because of presence of other door controllers, such as door opening mechanism, door locking mechanism and the like, in the door. That is, the provision of these other door controllers prevents the door construction from having therein an adequate space in which the mechanism for accomplishing the flush surface body arrangement is mounted.

SUMMARY OF THE INVENTION

It is therefore an essential object of the present invention to provide a method and a device which achieve the flush surface body arrangement of the door window construction irrespective of the provision of the other door controllers in the door.

It is another object of the present invention of provide an improved window regulator which assures a smooth and reliable up-and-down movement of the window pane.

It is still another object of the present invention to provide an improved window regulator which is easily assembled and easily adjusted.

According to the present invention, there is provided a method of regulating a window pane received in a hollow structure, the window pane being movable between a full-closed uppermost position and a full-open lowermost position. The method comprises in steps, (a) lowering the window pane from the full-closed uppermost position to a slight-open outboard position wherein the slightly opened window pane is positioned outboard with respect to the structure, (b) shifting the window pane from the slight-open outboard position to a slight-open inboard position wherein the slightly opened window pane is positioned inboard with respect to the structure, (c) lowering the window pane from the slight-open inboard position to the full-open lowermost position, (d) raising the window pane from the full-open lowermost position to the slight-open inboard position, (e) shifting the window pane from the slight-open inboard position to the slight-open outboard position, and (f) raising the window pane from the slight-open outboard position to the full-closed uppermost position.

According to the present invention, there is further provided a window regulator for a vehicle having a hollow structure in which a window pane is disposed in a manner to move between a full-closed uppermost position and a full-open lowermost position. The regulator comprises a base plate stationarily mounted in the hollow structure, a carrier device mounted to the base plate in a manner to be movable upward and downward with respect to the fixed base plate, a lifting device mounted in the hollow structure for moving the carrier device upward and downward with respect to the base plate, a window pane mounting plate holding the window pane and mounted to the carrier device in a manner to be movable between outboard and inboard sides in the hollow structure, and a shifting device mounted to the carrier device for shifting the window pane mounting plate between the outboard and inboard sides when the window paneis in a slight-open position slightly below the full-closed uppermost position.

DETAILED DESCRIPTION OF THE INVENTION

In the following, an embodiment of the present invention will be described in detail with reference to the attached drawings.

Figure 1:
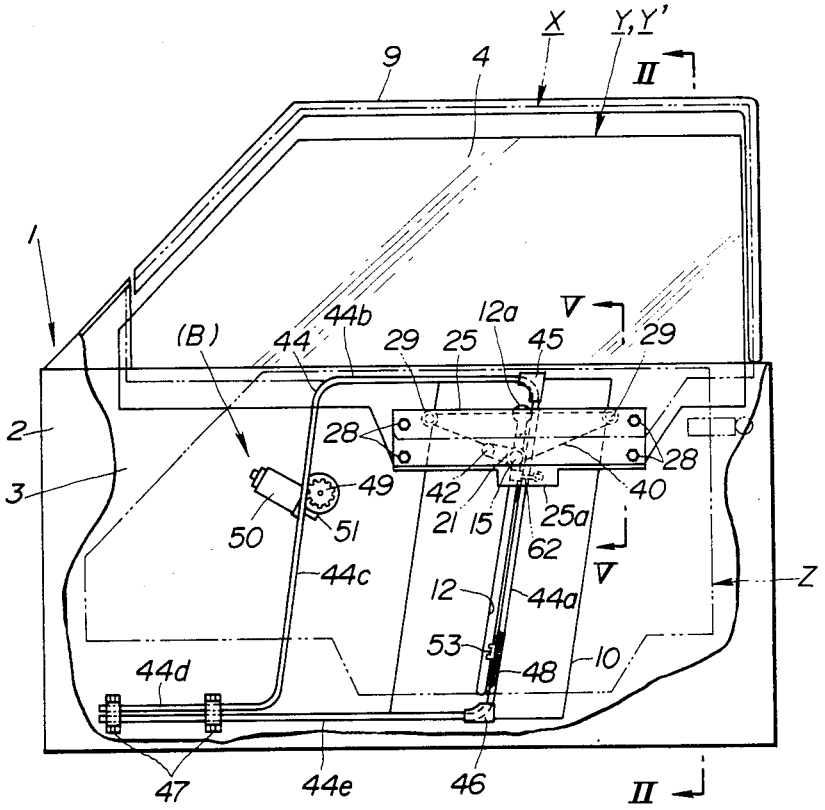
FIG. 1 is a partially broken plan view of a vehicle door to which the present invention is practically applied.

Referring to the drawings, particularly FIG. 1, there is shown a sashless door 1 to which the present invention is practically applied. The door 1 comprises an outer panel 2 and an inner panel 3 which are assembled in a known manner to form a hollow door structure.

Figure 5:
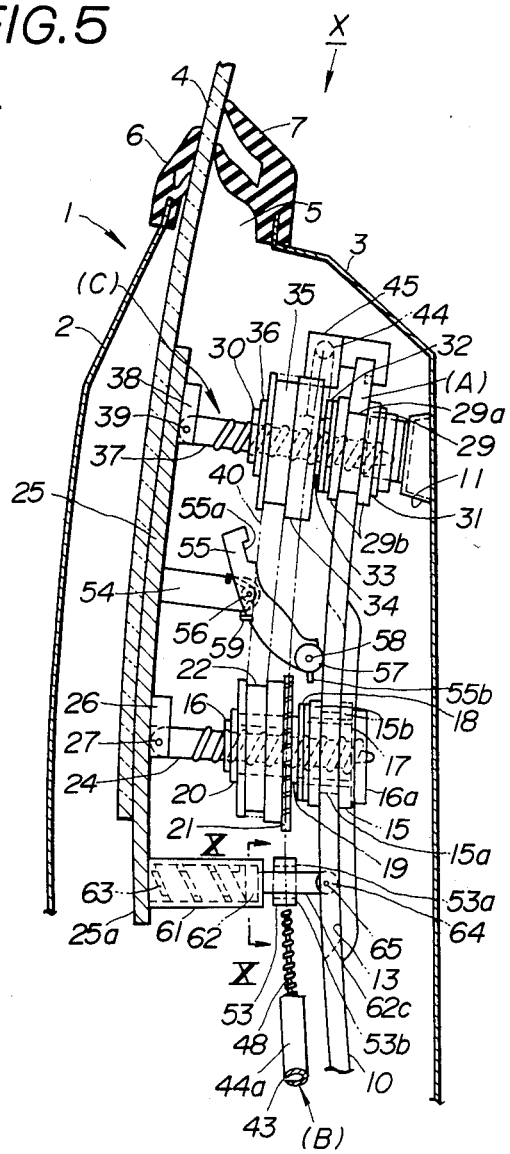
FIG. 5 is an enlarged sectional view taken along the line V—V of FIG. 1, showing a condition wherein the window pane is at its full-closed position.

As is seen from FIG. 5, the door structure 1 has between upper ends of the outer and inner panels 2 and 3 an elongate slot 5 through which a window pane 5 passes during its upward and downward movement as will become apparent as the description proceeds. The window pane 4 employed in this embodiment is substantially trapezoidal in shape as is seen from FIG. 1 and slightly curved inwardly as is seen from FIG. 3.

As is best seen from FIG. 5, the slot 5 is so sized as to permit a required displacement or shifting of the window pane 4 in a direction substantially prependicularr to the major surface of the door 1. That is, the transverse length (viz., the thickness) of the elongate slot 5 is several times as large as the thickness of the window pane 4. Weather strips 6 and 7 are fixed to the upper ends of the outer and inner panels 2 and 3 to stop rain drops. Each weather strip 6 or 7 is so sized and constructed as to cope with the required displacement of the window pane 4 in the slot 5.

Designated by numeral 9 (see FIGS. 1 to 3) is a sealing member mounted to an upper edge portion of a door opening formed in a vehicle body (not shown), against which the upper peripheral portion of the window pane 4 is pressed upon full closing of the windown pane 4 to achieve water tight sealing therebetween.

Figure 2:
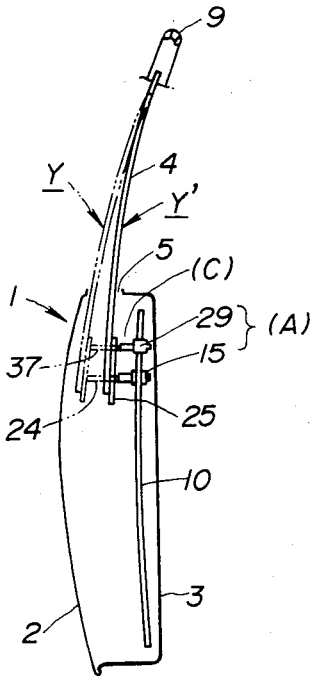
FIG. 2 is a sectional view taken along the line II—II of FIG. 1, showing inboard and outboard positions, shown by solid and phantom lines respectively, which are assumed by a window pane when the pane is at its slight-open position.
Figure 3:
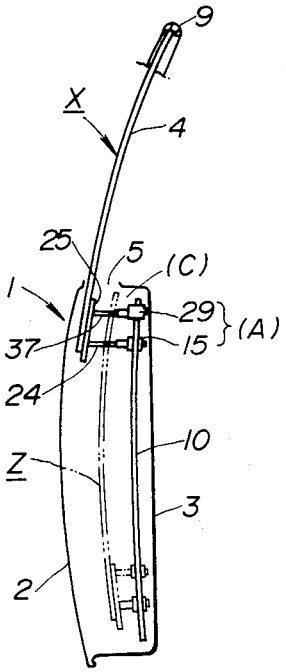
FIG. 3 is a view similar to FIG. 2, but showing full-closed and full-open positions, shown by solid and phantom lines respectively, which are assumed by the window pane during its upward and downward movement.

As may be understood from FIGS. 2 and 3, the window pane 4 can assume four outstanding positions, which are a full-closed position (X) wherein the upper peripheral portion of the window pane 4 is pressed against the body-mounted sealing member 9 having its lower portion located close to the outer panel 2, a slight-open outboard position (Y) wherein the window pane 4 is located somewhat below the full-closed position (X) having its lower portion located close to the outer panel 2, a slight-open inboard position (Y') wherein the window pane 4 is located somewhat below the full-closed position (X) having its lower portion located close to the inner panel 3 and a full-open positin (Z) wherein the window pane 4 is fully received in the door construction 1 and entirely located close to the inner panel 3.

Within the door construction 1, there is aranged a rectangular base plate 10 which is tightly connected through suitable brackets 11 to the inner panel 3. The base plate 10 acts as a so-called guide rail as will become clear hereinafter.

Figure 4:
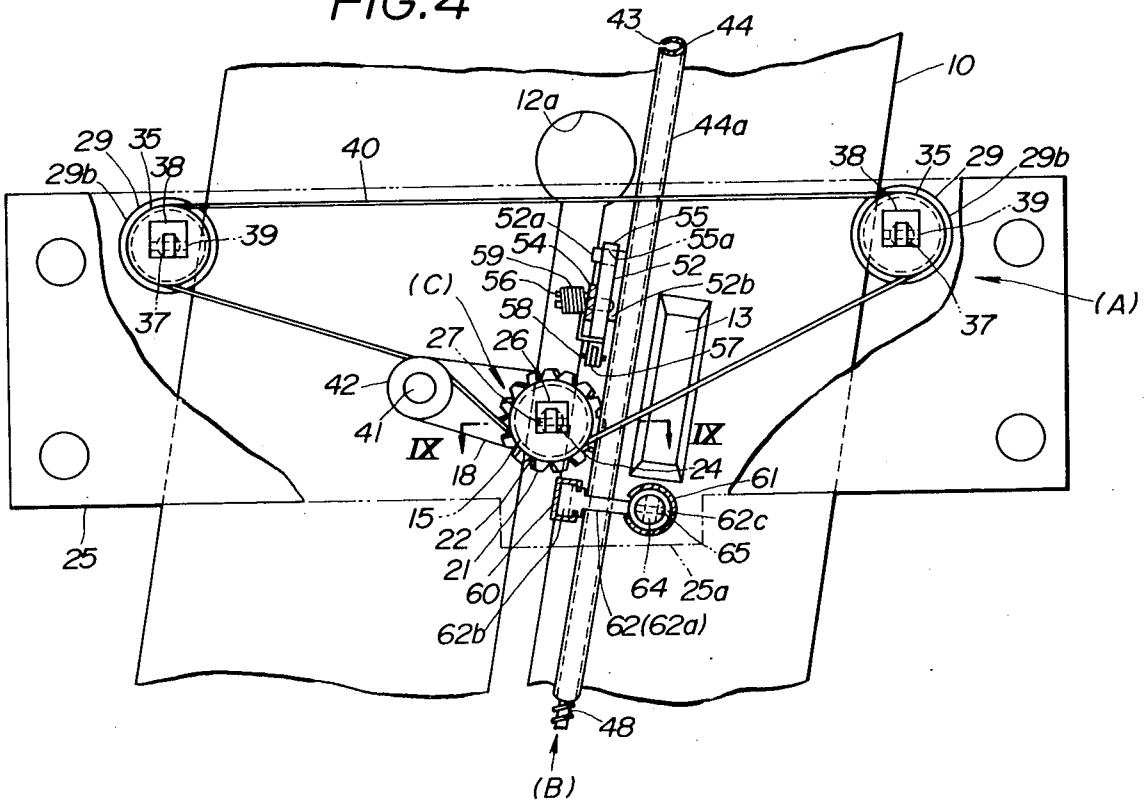
FIG. 4 is an enlarged plan view of an essential part of the window regulator of the present invention with some parts broken.

As is understood from FIGS. 1 and 4, the rectangular base plate 10 is formed with forward and rearward straight edges (no numerals) which are parallel with each other. The base plate 10 is further formed at its generally middle portion with an elongate slot 12 which extends parallel with the straight edges of the base plate 10.

As is seen from FIG. 4, the elongate slot 12 is formed at its top with an enlargd circular portion **12*a* through which an after-mentioned guided member 15 is passed for achieving a sliding engagement with the elongate slot 12. As is seen from FIG. 4, the plate 10 is formed at its upper-right portion with a rectangular groove 13 which is recessed toward the inner panel 3. As is seen from this drawing, the groove 13 extends parallel with the elongate slot 12. As may be understood from FIG. 6, the base plate 10 is formed at its upper portion between the elongate slot 12 and the rectangular groove 13 with a rectangular engaging opening 14**.

As is seen from FIG. 5, a pulley like guided member 15 is slidably engaged with the elongate slot 12. The guided member 15 comprises a smaller diameter shaft portion **15*a* which is slidably received in the elongate slot 12 and two larger diameter flange portions 15*b* and 15*b* which are formed at both ends of the shaft portion 15*a* and put therebetween the forward and rearward edges of the elongate slot 12**.

Figure 9:
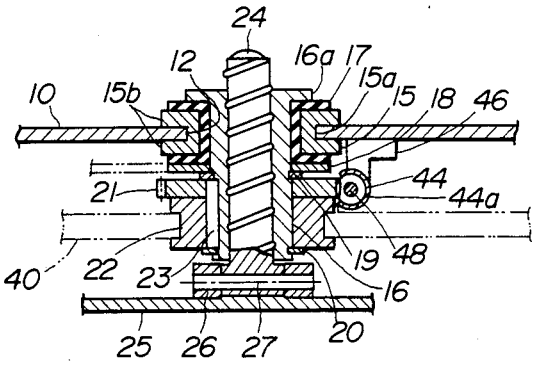
FIG. 9 is a sectional view taken along the line IX—IX of FIG. 4.

As is best understood from FIG. 9, the pulley like guided member 15 is formed with a center opening (no numeral) through which an internally threaded sleeve 16 is rotatably received through a bush 17. The sleeve 16 is formed at its inward end facing the inner panel 3 with a flange **16*a* which abuts on the inward flanged end of the bush 17**, as shown.

As is understood from FIGS. 4 and 9, a radially extending arm 18 is rotatably disposed about the sleeve 16 in a manner to slidably contact with the flanged end of the bush 17.

A snap ring 19 is fixed to a middle portion of the sleeve 16 to hold the bush 17 and the arm 18 on the sleeve 16. With this, the sleeve 16 is prevented from disengaging from the guided member 15.

Another snap ring 20 is fixed to the outboard end of the sleeve 16. Coaxially disposed about the sleeve 16 between the two snap rings 19 and 20 are a bevel gear 21 and a pulley 22 which are secured to the sleeve 16 through a key 23.

An externally threaded screw 24 is engaged with the sleeve 16 so that rotation of the sleeve 16 induces an axial movement of the screw 24 relative to the sleeve 16. As is seen from FIGS. 5 and 9, the outboard end of the screw 24 is pivotally connected to a lower portion of a window pane mounting plate 25 through a pivot device which comprises two spaced projections 26 adn 26 secured to the mounting plate 25 and a pivot pin 27. In the disclosed embodiment, the pivot pin 27 extends horizontally in a fore-and-aft direction with respect to the door construction.

As is seen from FIGS. 1 and 4, the window pane mounting plate 25 is in the form of an elongate plate which extends in the fore-and-aft direction. To the outer surface of the mounting plate 25, there is secured a lower portion of the window pane 4 through bolts and nuts 28 (see FIG. 1). The mounting plate 25 is formed with a downward projection **25*a*** at its lower side.

On the forward and rearward straight edges of the rectangular base plate 10, there are respectively arranged the other guided members 29 and 29 each comprising, similar to the above-mentioned guided member 15, a smaller diameter shaft portion **29*a* which is slidably engaged with the forward or rearward edge of the base plate 10 and two larger diameter flange portions 29*b* and 29*b* which are formed at both ends of the shaft portion 29*a* and partially put therebetween the forward or rearward edge of the base plate 10. With an arrangement which will be described hereinafter, these guided members 29 and 29 are slidably held on the edges of the base plate 10**.

Similar to the case of the guided member 15, an internally threaded sleeve 30 is rotatably disposed in each of the guided members 29 and 29 through a bush 31 (see FIG. 5). Furthermore, similar to the guided member 15, a spacer 32 as a substitute for the bush 17 and the arm 18, a snap ring 33 as a substitute for the snap ring 19, a spacer 34 as a substitute for the bevel gear 21, a pulley 35 as a substitute for the pulley 22 and a snap ring 36 as a substitute for the snap ring 20 are mounted about the sleeve 30 in this order. In short, the construction of each guided member 29 is substantially the same as that of the above-mentioned center guided member 15 except that in the guided members 29 and 29, the spacers 32 and 34 are used as substitutes for the arm 18 and the bevel gear 21 of the guided member 15.

Each pulley 35 is secured to the sleeve 30 through a key (not shown).

As is understood from FIG. 4, upon assembly, the guided members 29 and 29 are placed at positions somewhat above the center guided member 15. In the disclosed embodiment, the outer diameter of the pulley 35 of each guided member 29 is greater than that of the pulley 22 of the center guided member 15.

Similar to the case of the above-mentioned center guided member 15, an externally threaded screw 37 is engaged with each of the sleeves 30 and 30, which has an outboard end which is pivotally connected to an upper portion of the window pane mounting plate 25 through a pivot device which comprises two spaced projections 38 and 38 secured to the mounting plate 25 and a pivot pin 39. Similar to the case of the center guided member 15, the pivot pins 39 and 39 of the upper guided members 29 and 29 extend horizontally in a fore-and-aft direction with respect to the door.

A timing belt 40 is put around the pulleys 35 and 35 of the upper guided members 29 and 29 and the pulley 22 of the center guided member 15. A tension pulley 42 is rotatably connected through a shaft 41 to the leading end of the arm 18 and pressed against the timing belt 40 for applying a suitable tension to the belt 40. In the disclosed embodiment, the tension pulley 42 presses the belt 40 at a position between the forward pulley 35 and the center pulley 22. Although not shown in the drawing, a biasing spring is arranged to bias the arm 18 in a clockwise direction in FIG. 4.

With the arrangement as described hereinabove, it will be appreciated that the movement of the center guided member 15 along the elongate slot 12 of the base plate 10 and the movement of the forward and rearward guided members 29 and 29 along the forward and rearward edges of the base plate 10 induce upward and downward movement of the mounting plate 25 and thus that of the window pane 4.

When the bevel gear 21 is rotated in a counterclockwise direction in FIG. 4, the timing belt 40 transmits the counterclockwise rotation to the pulleys 22, 35 and 35 and thus to the internally threaded sleeves 16, 30 and 30. Thus, the externally threaded screws 24, 37 and 37 are axially projected outwardly from their associated sleeves 16, 30 and 30 thereby shifting the window pane mounting plate 25 outwardly, that is, toward the outer panel 2. In short, when the bevel gear 21 is rotated in a counterclockwise direciton in FIG. 4, the mounting plate 25 is shifted outwardly.

Because the forward and rearward pulleys 35 and 35 are larger in diameter than the center pulley 22, the rotation speed of the pulleys 35 and 35 is less than that of the pulley 22. Thus, the projected distance per unit time of the center screw 24 is greater than that of the forward and rearward screws 37 and 37. Thus, during the outward shifting, the mounting plate 25 and thus the window pane 4 are gradually inclined toward the inner panel 3 of the door 1. By suitably determining the sizes of the pulleys 22, 35 and 35, it is possible to eliminate or at least minimize the outward shifting of the upper end of the window pane 4. In this case, the window pane 4 operates as if it has a pivot center at the top.

While, when the bevel gear 21 is rotated in a clockwise direction in FIG. 4, the mounting plate 25 and thus the window pane 4 are pivotally shifted inwardly because of the reversed operation of the pulleys 22, 35 and 35 and the sleeves 16, 30 and 30. More specifically, upon this clockwise rotation, the window pane 4 is pivotally moved inwardly with its upper end acting as a pivot center.

As is seen from FIG. 4, the rectangular base plate 10 has further thereon an upwardly extending portion **44*a* of a guide tube 44 which is secured to the base plate 10 by means of retainers 45 and 46 (see FIG. 1). The portion 44*a* extends parallel with the elongate slot 12 and has a longitudinally extending slot 43 which faces forward to receive therein the teeth of the bevel gear 21**.

As is seen from FIG. 1, the guide tube 44 comprises the above-mentioned upwardly extending portion **44*a*, a forwardly extending portion 44*b* extending forward from the upper end of the portion 44*a*, a downwardly extending portion 44*c* extending downward from the forward end of the portion 44*b*, a forwardly extending shorter portion 44*d* extending forwardly from the lower end of the portion 44*c* and a forwardly extending longer portion 44*e* extending forwardly from the lower end of the portion 44*a*. The forwardly extending shorter portion 44*d* and a forward part of the forwardly extending longer portion 44*e* are arranged close to each other and secured to the inner panel 3 by means of retainers 47 and 47**.

Within the guide tube 44, there is slidably disposed a geared cable 48.

Designated by numeral 49 in FIG. 1 is a pinion which is connected through a speed reduction gear 51 to a reversable electric motor 50. These parts constitute a unit which is secured to the inner panel 3 near the downwardly extending portion **44*c* of the guide tube 44. The portion 44*c* of the guide tube 44 is formed with a slot 43 into which the teeth of the pinion 49 are projected to mesh with the geared cable 48. Thus, when the electric motor 50 is energized, the pinion 49 is rotated thereby sliding the geared cable 48 in forward or rearward direction in the guide tube 44**.

Referring back to FIG. 4, the teeth of the bevel gear 21 are projected into the slot 43 of the guide tube 44 to mesh with the geared cable 48. Thus, when, with the bevel gear 21 suppressed from moving upward or downward, the geared cable 48 in the upwardly extending portion **44*a* of the guide tube 44 is moved upward, the bevel gear 21 is rotated in a counterclockwise direction inFIG. 4. While, when the geared cable 48 is moved downward, the bevel gear 21** is rotated in a clockwise direciton.

To a suitable portion of the geared cable 48 received in the portion **44*a* of the guide tube 44, there is connected an upper operating piece 52 which projects forward through the slot 43 of the guide tube 44. The piece 52 is formed at its upper portion with an outward projection 52*a* and at is lower portion with a pointed end 52*b***.

As is seen from FIG. 1, the geared cable 48 has, at a portion below the upper operating piece 52, a lower operating piece 53 which projects forward through the slot 43 of the guide tube 44. The piece 53 is formed at its upper end with a forwardly extending shorter projection **53*a* and at its lower end with a forwardly extending longer projection 53*b***.

As is seen from FIG. 5, the window pane mounting plate 25 is provided with a supporting rod 54 which projects inwardly. An engaging lever 55 is pivotally connected at is generally middle portion to a leading end of the supporting rod 54 through a pivot pin 56. An upper arm portion of the engaging lever 55 is formed with a recess 55*a* which is engageable with the projection 52*a* of the upper operating piece 52. The recess 55*a* is so sized as to snugly receive therein the projection 52*a*. A lower arm portion of the engaging lever 55 is provided with a roller 57 which is rotatably connected thereto through a shaft 58 to run on the outer surface of the base plate 10. Designated by numeral 55*b* is a stopper pin which is fixed to the lower arm portion of the lever 55 for the purpose which will be understood herein after.

Disposed about the shaft 56 is a coil spring 59 which biases the engaging lever 55 in a counterclockwise direction about the shaft 56 in FIG. 5 for constantly pressing the roller 57 on the outer surface of the base plate 10.

When the window pane 4 is somewhat lowered from the full-closed position (X) to the slight-open outboard position (Y), the lower end of the engaging lever 55 and the roller 57 connected thereto are brought into engagement with the opening 14 of the base plate 10 thereby suppressing further downward movement of the window pane 4. While, when, under this condition, the upper operating piece 52 of the geared cable 48 is lowered to a certain position, the lower end of the engaging lever 55 is pushed out from the opening 14 by the pointed end 52*b* of the piece 52 and at the same time the recess 55*a* of the engaging lever 55 is brought into engagement with the projection 52*a* of the upper operating piece 52. Thus, thereafter, the downward movement of the geared cable 43 in the upwardly extending guide tube portion 44*a* brings the window pane 4 to the full-open position (Z) allowing the roller 57 to run on the outer surface of the base plate 10.

When, with the window pane 4 assuming the full open position (Z), the geared cable 48 in the portion 44*a* is moved upward, the engagement between the recess 55*a* of the engaging lever 55 and the projection 52*a* of the upper operating piece 52 causes the window pane 4 to move upwardly. When now the window pane 4 comes to the slight open inboard position (Y') slightly below the full closed position (X), the lower end of the engaging lever 55 and the roller 57 connected thereto are brought into engagement with the opening 14 of the base plate 10 again and at the same time, the recess 55*a* of the lever 55 is disengaged from the projection 52*a* of the upper operation piece 52.

Thus, thereafter, the window pane 4 is kept at the slight open position (Y') for a while even when the upper operating piece 52 is moved upward together with the geared cable 48. Of course, downward movement of the window pane 4 is suppressed because of the engagement between the operating lever 55 and the opening 14.

Because of the stopper pin 55*b* fixed to the engaging lever 55, the lower end of the lever 55 and the roller 57 connected thereto are prevented from deeply inserting the opening 14.

Figure 10:
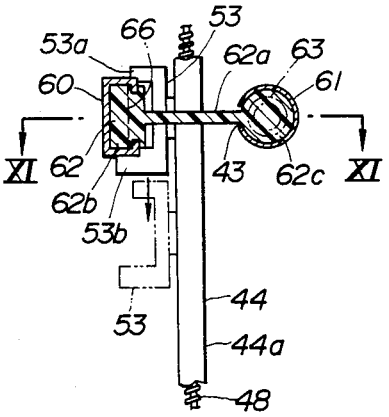
FIG. 10 is a sectional view taken along the line X—X of FIG. 5.
Figure 11:
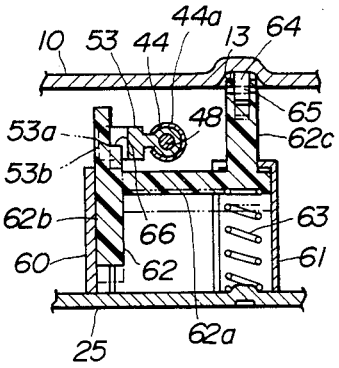
FIG. 11 is a sectional view taken along the line XI—XI of FIG. 10.

As is seen from FIGS. 10 and 11, to an inside surface of the downward projection 25*a* of the window pane mounting plate 25, there are secured both first and second guide frames 60 and 61 which are projected inwardly, that is, toward the base plate 10. As is seen from FIG. 10, the first guide frame 60 is of a channel member and the second guide frame 61 has a generally C-shaped cross section. A slide unit 62 is slidably engaged with both the first and second guide frames 60 and 61. That is, the slide unit 62 comprises a first slide part 62*b* slidably received in the first guide frame 60, a second slide part 62*c* slidably received in the second guide frame 61 and an interconnecting part 62*a* by which the first and second slide parts 62*b* and 62*c* are integrally connected. As is seen from FIG. 11, the entire of the slide unit 62 has a generally h-shaped plan view.

Within the second guide frame 61, there is disposed a compression spring 63 for biasing the slide unit 62 inwardly, that is, toward the base plate 10.

The inward end of the second slide part 62*c* is provided with a roller 64 which is rotatably connected thereto through a shaft 65. The roller 64 rolls on the outer surface of the base plate 10 until the window pane 4 is raised somewhat from the slight open outboard position (Y). However, when the window pane 4 is at a position between the somewhat raised position and the full closed-position (X), the roller 64 is put in the groove 13 of the base plate 10.

The inward end of the first slide part 62*b* is formed with a step-like cut portion 66 (see FIG. 11). During the time for which the roller 64 is rolling on and along the outer surface of the base plate 10, the shorter projectin 53*a* of the lower operating piece 62 passes through the step-like cut portion 66, but the longer projection 53*b* of the same is brought into engagement with the inward end of the first slide part 62*b*.

When the roller 64 is put in the groove 13 and the entire of the slide unit 62 is thrusted out from the first and second guide frames 60 and 61 due to the biasing force of the spring 63, the step-like cut portion 66 of the slide unit 62 is moved inwardly thereby moving apart from a travelling path of the shorter projection 53*a* of the lower operating piece 53 causing a portion of the first slide part 62*b* to be held by the shorter and longer projections 53*a* and 53*b* of the piece 53. This condition is illustrated by solid lines in FIGS. 10 and 11.

As will be described in detail hereinafter, the slide unit 62 and the lower operating piece 53 function to move up the window pane 4 from the slight open outboard position (Y) to the full-closed position (X) and move down the same from the full closed-position (X) to the slight open outboard position (Y).

Thus, in the embodiment as described hereinabove, the three guided members 15, 29 and 29 constitute a carrier (A) which is slidably mounted to the base plate 10. While, the motor 50, the speed reduction gear 51, the pinion 49, the geared cable 48, the guide tube 44, the upper operating piece 52, the lower operating piece 53, the engaging lever 55 and the slide unit 62 constitute a lifting device (B) which is mounted within the door 1 to move up and down the above-mentioned carrier (A) along the base plate 10. The motor 50, the speed reduction gear 51, the pinion 49, the geared cable 48, the guide tube 44, the pinion 21, the pulleys 22 and 35, the timing belt 40, the internally threaded sleeves 16, 30 and 30, and the screws 24, 37 and 37 constitute a shifting device (C) which functions to shift the window pane mounting plate 25 outwardly or inwardly.

As is understood from the above description, in the embodiment, the motor 50, the speed reduction gear 51, the pinion 49 and the geared cable 48 constitute a driving means which is commonly used for the lifting device (B) and the shifting device (C).

In the following, operation of the window regulator of the invention will be described with reference to the drawings.

For ease of understanding, the description of operation will be commenced with respect to the full closed condition (X) of the window pane 4 which is shown by FIG. 5. In this condition, the roller 64 is put in the groove 13, and the slide unit 62 is pushed inwardly due to the biasing force of the spring 63 having a portion of the first slide part 62*b* thereof held by the shorter and longer projections 53*a* and 53*b* of the lower operating piece 53. Thus, the weights of the window pane 4 and the mounting plate 25 are supported by the longer projection 53*b* of the piece 53. Furthermore, under this condition, the screws 24, 37 and 37 are maximally projected from their associated sleeves 16, 30 and 30 causing the window pane 4 to be located near the outer panel 2 of the door 1. Furthermore, under this condition, the roller 57 held by the engaging lever 55 is pressed on the outer surface of the base plate 10 just above the engaging opening 14 due to the forece of the spring 59.

When now the electric motor 50 is energized to rotate the pinion 49 in a clockwise direction in FIG. 1, the geared cable 48 in the upwardly extending portion 44*a* of the guide tube 44 is lowered causing the lower operating piece 53 fixed thereto to move downward. With this, the shorter projection 53*a* of the piece 53 is brought into engagement with the first slide part 62*b* and moves down the window pane 4.

Thereafter, the roller 64 gets on the outer surface of the base plate 10 from the groove 13 causing the slide unit 62 to be pushed outward against the force of the compression spring 63. When, during this, the cut portion 66 of the slide unit 62 comes to a position just below the projection 53*a*, the lower end of the engaging lever 55 and the roller 57 held by it are brought into engagement with the opening 14 thereby suppressing but temporarily the further downward movement of the window pane 4 resulting in that the window pane 4 assumes the slight open outboard position (Y) with its peripheral portion slightly separated from the sealing member 9 mounted to the upper edge portion of the door opening of the vehicle body.

When thereafter the geared cable 48 in the portion 44*a* of the guide tube 44 is further lowered, the lower operating piece 53 is moved downward having the shorter projection 53*a* thereof passed through the cut portion 66 of the slide unit 62. During this, because of the engagement between the geared cable 48 and the bevel gear 21, the bevel gear 21 is rotated in a clockwise direction in FIG. 4.

It is to be noted that while the window pane 4 is moving upward together with the geared cable 48, the bevel gear 21 is moved upward without rotation. That is, only when a different movement appears between the window pane 4 and the geared cable 48, the bevel gear 21 is forced to rotate.

When the bevel gear 21 is rotated in a clockwise dirction in FIG. 4, the internally threaded sleeves 16, 30 and 30 are rotated in the same direction causing the externally threaded screws 24, 37 and 37 to enter the guided members 15, 29 and 29, as has been described hereinabove.

Becuase the axially moved distance of the screw 24 is greater than that of each of the screws 37 and 37, the window pane 4 is pivotally moved inwardly with its lower end shifted toward the inner pane 3. That is, the window pane 4 is pivoted slightly in a counterclockwise direction in FIG. 2 about its upper end.

Figure 8:
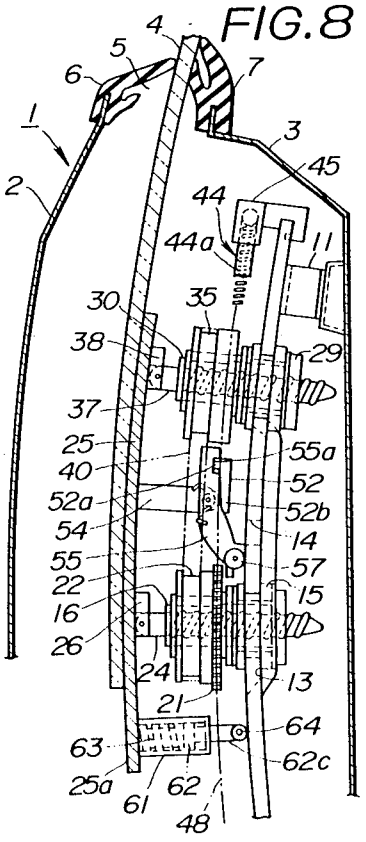
FIG. 8 is a view similar to FIG. 5, but showing a condition wherein the window pane is lowered somewhat from the slight-open inboard position of FIG. 7.
Figure 7:
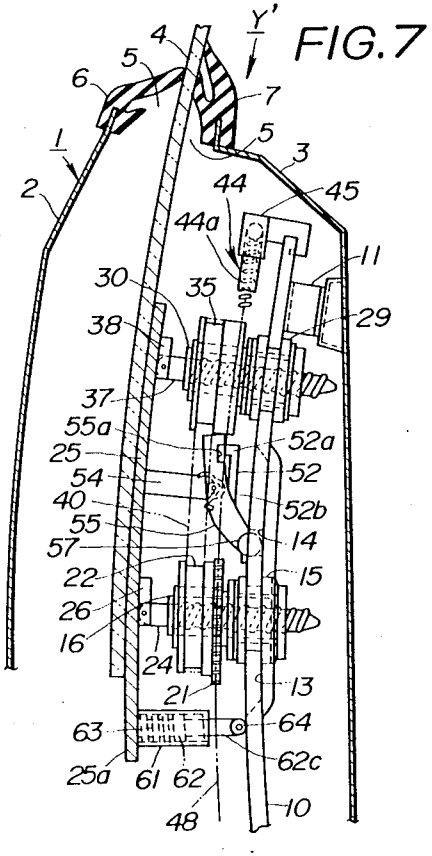
FIG. 7 is a view similar to FIG. 5, but showing a conditin wherein the window pane assumes its slight-open inboard position.

When the moved distances of the screws 24, 37 and 37 become to their maximum degrees, the window pane 4 comes to the slight open inboard postion (Y'). During this movement, as is shown in FIG. 7, the upper operating piece 52 is lowered to a position just above the engaging lever 55, and the piece 52 pushes out the lower end of the engaging lever 55 with its pointed end 52*b* from the opening 14, and at the same time, as is shown in FIG. 8, the recess 55*a* of the engaging lever 55 is brought into engagment with the projection 52*a* of the upper operating piece 52 and the roller 57 is brought into contact with the outer surface of the base plate 10 just below the opening 14. Thus, thereafter, the window pane 4 is moved in parallel downward together with the geared cable 48 having the roller 57 running on the outer surface of the base plate 10. With this, the window pane 4 comes to the full-open position (Z).

When the window pane 4 reaches the position (Z), a known sensor (not shown) senses the reaching and stops operation of the motor 50. With this, the movement of the geared cable 48 stops and thus, the window pane 4 stops at the full-open position (Z).

When upward movement of the window pane 4 from the full-open position (Z) is required, it is necessary to operate the motor 50 in a manner to rotate the pinion 49 in a counterclockwise direction in FIG. 1. In this case, reversed operations of the parts are carried out as will be described in the following.

That is, when the geared cable 48 in the upwardly exending guide tube portion 44*a* is moved upward, the window pane 4 is lifted keeping the engagement between the projection 52*a* of the upper operating piece 52 and the recess 55*a* of the engaging lever 55. When, as is seen from FIG. 7, the window pane 4 comes to the slight-open inboard position (Y'), the lower end of the engaging lever 55 and the roller 57 held by the same are brought into engagement with the engaging opening 14 of the base plate 10 and the recess 55*a* of the engaging lever 55 is disengaged from the projection 52*a* of the upper operating piece 52 so that thereafter the upward movement of the window pane 4 stops temporarily.

When, thereafter, the geared cable 48 in the guide tube portion 44*a* is further moved upward, the bevel gear 21 and the sleeves 16, 30 and 30 are rotated in a counterclockwise direction in FIG. 4 causing the screws 24, 37 and 37 to project outwardly from the associated guided members 15, 29 and 29. Because of the difference between the axially moved distances of the screw 24 and each of the screws 37 and 37, the window pane 4 is pivotally moved outwardly with its lower end shifted toward the outer panel 2 of the door. That is, the window pane 4 is pivoted slightly in a clockwise direction in FIG. 2 about its upper end. This movement is carried out without abnormally pressing the upper peripheral portion of the pane 4 on the seal member 9 of the door opening of the vehicle body.

Figure 6:
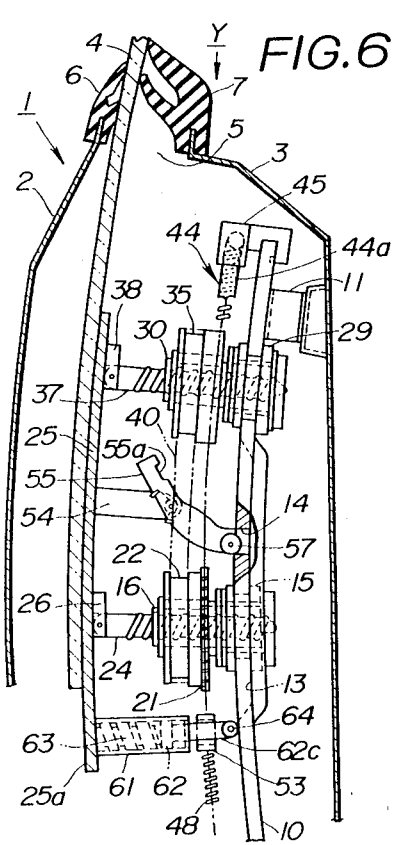
FIG. 6 is a view similar to FIG. 5, but showing a condition wherein the window pane assumes its slight-open outboard position.

When, as is shown in FIG. 6, the window pane 4 comes to the slight-open outboard position (Y), the longer projection 53*b* of the lower operating piece 53 is brought into contact with the lower surface of the first slide part 62*b* of the slide unit 62, and thus thereafter, the lower operating piece 53 pushes the window pane 4 up to the full-closed position (X).

During the upward movement of the window pane 4, the roller 64 is received in the groove 13 allowing the slide unit 62 to project inwardly due to the force of the compression spring 63 and to grasp the first slide part 62*b* with the shorter and longer projections 53*a* and 53*b*.

When the window pane 4 comes to the full-closed position (X), the known sensor (not shown) senses the reaching and stops operation of the motor 50. With this, the movement of the geared cable 48 stops and thus the window pane 4 stops at the full-closed positon(X).

If desired, the following modifications may be employed in the present invention.

Although, in the above-mentioned embodiment, the axially moved distances of the screws 24, 37 and 37 are made different by making the outer diameters of the pulleys 22, 35 and 35 different, the difference in the moved distances can be achieved by making the pitches of the screws 24, 37 and 37 different. In this case, identical pulleys can be used for the pulleys 22, 35 and 35.

Furthermore, if desired, the diameters of the pulleys 22, 35 and 35 may be made equal and the pitches of the screws 24, 37 and 37 may be made equal. In this case, the entire of the window pane 4 is shifted in parallel between the two slight open positions (Y) and (Y') without making a pivoting movment thereof.

Although the foregoing descirption is directed to a window regulator mounted in a vehicle door, the present invention is applicable also to a window regulator mounted in a vehicle body.

As will be understood from the foregoing description, in accordance with the present invention, it is possible to move the window pane smoothly and reliably irrespective of the presence of other door control mechanisms (such as the door opening mechanism, door locking mechanism and the like) which are mounted in the door. Furthermore, upon full closing of the window pane, the outer surface of the window pane becomes substantially flush with the outer surface of the door and that of the vehicle body. Thus, the air resistance developed when the vehicle runs can be considerably reduced and the external appearance of the vehicle can be improved.

What is claimed is:

1. A window regulator for a vehicle having a hollow structure in which a window pane is disposed in a manner to move between a full-closed uppermost position and a full-open lowermost position, said window regulator comprising:

a base plat stationarily mounted in said hollow structure;

a carrier device mounted to said base plate in a manner to be movable upward and downward with respect to the fixed base plate, said carrier device including first, second, and third sliding units which run on and along given ways defined by said base plate, said first sliding unit being placed between and below said second and third sliding units;

a lifting device mounted in said hollow structure for moving said carrier device upward and downward with respect to the base plate;

a window pane mounting plate mounted to said carrier device in a manner to be movable between outboard and inboard sides in said hollow structure; and a shifting device mounted to said carrier device for shifting said window pane mounting plate between said outboard and inboard sides when said window pane is at a slightopen position slightly below the full-closed uppermost position.

2. A window regulator as claimed in claim 1, in which each of said sliding units constitutes some parts of said shifting device and comprises:

an internally threaded sleeve rotatably supported by said base plate;

a pulley secured to said sleeve to rotate therewith;

an externally threaded screw operatively engaged with said sleeve in such a manner that relative rotation therebetween induces extraction or retraction of said screw relative to said sleeve; and means for pivotally connecting one end of said screw to said window pane mounting plate.

3. A window regulator as claimed in claim 2, in which said first sliding unit is slidably engaged with an elongate slot formed in said base plate.

4. A window regulator as claimed in claim 2, further comprising a timing belt which is operatively put on the pulleys of the three sliding units to achieve simultaneous rotation of the pulleys.

5. A window regulator as claimed in claim 4, in which tension is applied to said timing belt by a tensioner.

6. A window regulator as claimed in claim 4, in which said first sliding unit further comprises a gear which is secured to the associated sleeve to rotate therewith.

7. A window regulator as claimed in claim 6, in which said gear is a bevel gear.

8. A window regulator as claimed in claim 7, in which said lifting device comprises:

a geared cable axially movable relative to said base plate, said geared cable being meshingly engaged with said bevel gear;

an upper operating piece fixed to said geared cable to move therewith;

a lower operating piece fixed to said geared cable at a position below said upper operating piece;

a catch device mounted on said window pane mounting plate for selectively catching one of said upper and lower operating pieces to transmit the movement of said geared cable to said mounting plate; and a drive means for driving said geared cable.

9. A window regulator as claimed in claim 8, in which said catch device comprises:

an engaging lever pivotally supported by said window pane mounting plate, said lever having an upper arm which is engageable with said upper operating piece to transmit a downward movement of said geared cable to the mounting plate when said mounting plate is positioned at the inward side in the structure; and a spring-biased slide unit connected to said window pane mounting plate at a position below said engaging lever, said slide unit being engageable with said lower operating piece to transmit an upward movement of said geared cable to the mounting plate when said mounting plate is positioned at the outward side in the structure.

10. A window regulator as claimed in claim 9, in which said engaging lever has a lower arm equipped with a roller which runs on the surface of the base plate, said roller being caught by an opening of said base plate to stop the upward and downward movement of said mounting plate irrespective of the axial movement of said geared cable.

11. A window regulator as claimed in claim 10, in which said spring-biased slide unit is equipped with a roller which runs on the surface of said base plate, said roller being received in a groove of said base plate when said window pane assumes said full-closed uppermost position.

12. A window regulator as claimed in claim 11, in which said upper operating piece comprises a projection lockably engageable with a recess formed in said upper arm of said engaging lever and a pointed end which is contactable with said lower arm of said engaging lever to push out the roller of the lower arm from the catch opening formed in the base plate when said window pane mounting plate is about to be lowered from the inward side position in the hollow structure.

13. A window regulator as claimed in claim 12, in which said lower operating piece comprises a shorter upper projection and a longer lower projection, said projections putting therebetween a portion of the spring-biased slide unit for achieving a tight connection with said geared cable when said window pane is moved from the outside position in the hollow structure toward the full-closed uppermost position.

* * * * *